United States Patent [19]

Ishida et al.

[11] 4,300,510

[45] Nov. 17, 1981

[54] FUEL PRESSURE REGULATOR OF FUEL INJECTION SYSTEM

[75] Inventors: Yoshiyuki Ishida, Tokyo; Seikoh Satoh, Yokohama, both of Japan

[73] Assignee: Nissan Motor Company, Limited, Yokohama, Japan

[21] Appl. No.: 50,155

[22] Filed: Jun. 20, 1979

[30] Foreign Application Priority Data

Jun. 23, 1978 [JP] Japan ..... 53-76260

[51] Int. Cl.[3] ..... F02M 37/04

[52] U.S. Cl. ..... 123/512; 123/459; 123/463; 137/115; 137/510

[58] Field of Search ..... 123/136, 139 R, 139 AV, 123/139 AF, 139 AW, 456, 457, 459, 460, 463, 512, 511; 137/115 X, 510 X, 881, 885

[56] References Cited

U.S. PATENT DOCUMENTS

| | | | |
|---|---|---|---|
| 1,933,318 | 10/1933 | Doen | 137/881 |
| 2,633,146 | 3/1953 | Witt | 123/139 AV |
| 2,875,742 | 3/1959 | Dolza | 123/139 AF |
| 3,195,556 | 7/1965 | Norstrud et al. | 137/115 |
| 3,405,730 | 10/1968 | Baumann | 137/510 |

FOREIGN PATENT DOCUMENTS

| | | | |
|---|---|---|---|
| 929603 | 6/1955 | Fed. Rep. of Germany | 137/510 |
| 2351202 | 4/1975 | Fed. Rep. of Germany | 137/115 |
| 2903907 | 8/1979 | Fed. Rep. of Germany | 137/510 |
| 843427 | 8/1960 | United Kingdom . | |
| 962829 | 1/1964 | United Kingdom . | |
| 1098822 | 1/1968 | United Kingdom . | |
| 1123998 | 8/1968 | United Kingdom . | |
| 1260305 | 1/1972 | United Kingdom . | |
| 1513753 | 6/1978 | United Kingdom . | |
| 2017264 | 10/1979 | United Kingdom | 137/510 |

*Primary Examiner*—Ira S. Lazarus
*Assistant Examiner*—Magdalen Moy
*Attorney, Agent, or Firm*—Schwartz, Jeffery, Schwaab, Mack, Blumenthal & Koch

[57] ABSTRACT

A fuel pressure regulator for use in a fuel injection system of a gasoline fueled engine, comprises a fuel distributor pipe having an inlet and a plurality of outlets connected to fuel injections, a casing secured to a portion of the fuel distributor pipe, a diaphragm member secured between the portion of the distributor pipe and the casing, and a fuel discharge nozzle disposed interiorly of the distributor pipe to discharge the fuel out of the distributor pipe, so that the possibility of fuel leakage in the piping of the fuel injection system is effectively decreased, rendering easier assembly of the fuel injection system and lowering the production cost of the same.

7 Claims, 3 Drawing Figures

FUEL PRESSURE REGULATOR OF FUEL INJECTION SYSTEM

BACKGROUND OF THE INVENTION

This invention relates to an improvement in a fuel injection system of a gasoline fueled internal combustion engine, and more particularly to a fuel pressure regulator for use in the fuel injection system, for controlling the pressure of the fuel to be injected from a fuel injector.

SUMMARY OF THE INVENTION

It is the main object of the present invention to provide an improved fuel pressure regulator for use in a fuel injection system, which can simplify the fuel pipings of the fuel injection system, improving the durability of the fuel injection system.

It is another object of the present invention to provide an improved fuel pressure regulator for use in a fuel injection system, by which the possibility of fuel leakage in the fuel piping of the fuel injection system is considerably decreased as compared with the case of a conventional fuel pressure regulator.

It is a further object of the present invention to provide an improved fuel pressure regulator for use in a fuel injection system, which improves the operation efficiency in assemblying the fuel injection system, and lowers the production cost of the fuel injection system.

These and other objects, features and advantages of the fuel pressure regulator according to the present invention will be more apparent from the following description when taken in conjunction with the accompanying drawings in which the same reference numerals are assigned to the corresponding part and elements throughout the embodiments.

DETAILED DESCRIPTION OF PREFERRED EMBODIMENTS

Figure 1:
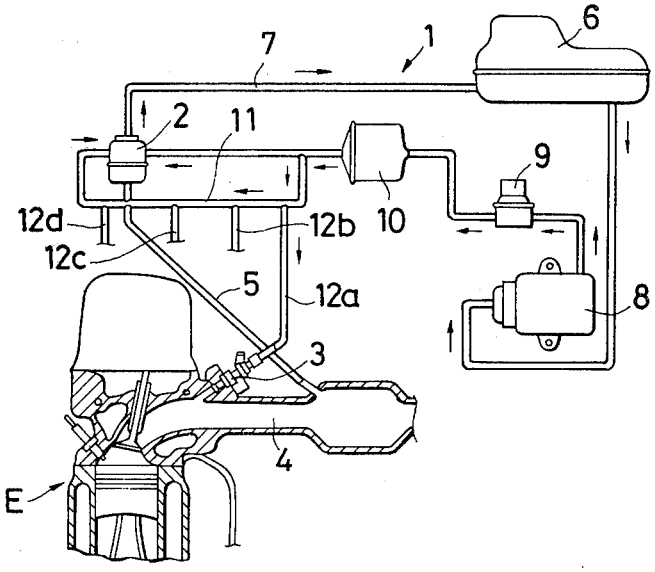
FIG. 1 PRIOR ART
FIG. 1 is a schematic illustration of a fuel injection system of a gasoline fueled internal combustion engine, including a prior art fuel pressure regulator.

As shown in FIG. 1, a conventional fuel injection system 1 for a gasoline fueled internal combustion engine E is usually provided with a fuel pressure regulator 2 for maintaining the pressure of the fuel to be injected from a fuel injector 3 at a constant value in order to precisely control the amount of fuel supplied to the engine E. The amount of the fuel injected from the fuel injector 3 is in general proportional to the pressure differential between the fuel pressure and the intake vacuum generated in an intake passageway 4. Accordingly, the fuel pressure regulator 2 is constructed and arranged to receive the fuel pressure and the intake vacuum (introduced through a vacuum line 5) at the opposite sides of a diaphragm enclosed therein to compare these two pressures, and then return excessive fuel into a fuel tank 6 through a return line 7 so that the pressure differential is always maintained at a constant value.

The fuel from a fuel pump 8 is supplied under pressure through a fuel damper 9 and a fuel filter 10 into the fuel pressure regulator 2, and introduced into a distributor pipe 11 which is formed in parallel with the fuel pressure regulator 2. The fuel introduced into the distributor pipe 11 is then supplied to a plurality of fuel injectors 4 (only one is shown) through branched lines 12*a*, 12*b*, 12*c* and 12*d*, respectively.

However, such a fuel injection system has encountered the following problems: Since the piping in connection with the fuel pressure regulator 2 is considerably complicated as seen from FIG. 1, it is liable to cause leakage in the piping by loosening of the connections (clamping connections by clamp couplings and/or the screw connections by connectors) of the piping due to, for example, vibration of the fuel injection system 1. Furthermore, many connections in the piping unavoidably increase the number of constituting parts such as the clamp couplings and the connectors and the number of the steps in assembly, contributing to increase in production cost and to deterioration in operation efficiency.

In view of the above, the present invention contemplates to solve the problems encountered in the fuel injection system provided with a conventional fuel pressure regulator, by forming a pressure regulating section integrally with a fuel distributor pipe through which the fuel is distributed to a plurality of fuel injectors.

Figure 2:
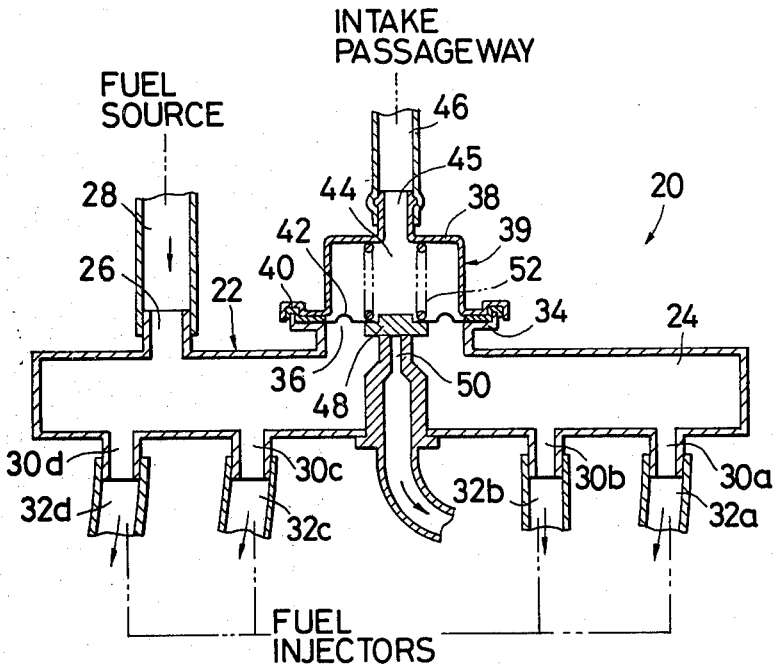
FIG. 2 is a cross-sectional view of a preferred embodiment of a fuel pressure regulator in accordance with the present invention.

Referring now to FIG. 2, there is shown a preferred embodiment of a fuel pressure regulator 20 for use in a fuel injection system of a gasoline fueled internal combustion engine (not shown). The regulator 20 is composed of a straight elongate fuel distributor pipe 22 in which a fuel chamber 24 is defined. The pipe 22 is integrally provided with a fuel inlet 26 which is connected through a fuel supply line 28 to a fuel source such as a fuel pump (not shown). The pipe 22 is further integrally provided with four fuel outlets 30*a* to 30*d* which are connected through four fuel supply lines 32*a* to 32*d* to four fuel injectors (not shown), respectively. The outlets 30*a* to 30*d* are located spaced apart certain distances. The pipe 22 is integrally formed with a flange portion 34 defining an opening 36.

A cup-shaped diaphragm casing 38 forming part of a pressure control section 39 is securely connected at its flange portion 40 with the flange portion 34 of the pipe 22, securely putting a diaphragm member 42 between the flange portions 34 and 40. The connection between the two flange portions 34 and 40 is, in this instance, established by crimping the flange portion 40 of the casing 38 over the flange portion 34 of the pipe 22, interposing the diaphragm 42 therebetween. In this regard, it is preferable that the pipe 22 is formed of die-cast aluminum or cast brass, and the casing 38 is formed of a pressed steel plate.

The diaphragm member 42 is located to close the opening 36 and separates the fuel chamber 24 defined in the pipe 22 and a vacuum chamber 44 defined in the casing 38. The vacuum chamber 44 communicates through a vacuum inlet 45 and a vacuum supply line 46 with an intake air passageway (not shown) through which the engine cylinders of the engine are communicable with the atmosphere. The diaphragm member 42 is provided with a valve member 48 at the central portion thereof.

A fuel discharge nozzle 50 is secured through the wall of the pipe 22 so that the tip of the nozzle is disposed in the fuel chamber 24 of the pipe 22. As shown, the nozzle 50 is positioned so that the tip thereof is located opposite to and in close proximity to the valve member 48. Accordingly, nozzle 50 is closed when the valve member 48 urgingly contacts with the tip of the nozzle 50 by the bias of a spring 52. The spring 52 is disposed in the vacuum chamber 44 and between the inner wall surface of the casing 38 and the diaphragm member 42. The nozzle 50 is connected to, for example, a fuel tank (not shown).

With the thus arranged fuel pressure regulator 20, when the valve member 48 contacts the tip of the fuel discharge nozzle 50, the fuel introduced under pressure through the fuel inlet 26 is supplied through the fuel outlets 30*a* to 30*d* into the fuel injectors. When the valve member 48 separates from the tip of the fuel discharge nozzle 50, a part of the fuel introduced into the fuel chamber 24 of the pipe 22 is discharged out of the fuel chamber 24 through the fuel discharge nozzle 50.

It will be appreciated that the fuel pressure in the fuel chamber 24 is controlled by the action of the pressure control section 39 to maintain constant the pressure differential between the fuel pressure and the intake vacuum at the instant that the fuel is injected from the fuel injector. Accordingly, the diaphragm member 42 is movable in response to the pressure differencial between the fuel pressure $P_1$ in the fuel chamber 24 and the intake vacuum $P_0$ introduced into the vacuum chamber 44, and floats and rests at a position where the fuel pressure $P_1$ and the intake vacuum $P_0$ balance.

Now, if the fuel pressure $P_1$ increases though the intake vacuum does not vary, the differential pressure between the fuel pressure and the intake vacuum increases and accordingly the amount of fuel injected from the fuel injector increases. To compensate this, the diaphragm member 42 moves upwardly in the drawing in response to the increase in the intake vacuum, by which the valve member 48 is separated from the tip of the fuel discharge nozzle 50. Hence, a part of the fuel in the fuel chamber 24 is discharged through the nozzle 50 and returns to the fuel tank. As a result, the fuel pressure within the fuel chamber 24 is lowered until the diaphragm member 42 is kept at the position where the fuel pressure and the intake vacuum balance in order to maintain the above-mentioned pressure difference $(P_1-P_0)$. By virtue of the above-mentioned fuel pressure regulator, the fuel amount injected from the fuel injector is a function of the time duration at which the valve of the fuel injector opens to inject fuel, and therefore the injected fuel amount can become precisely proportional to the pulse width of the pulse signal supplied to the fuel injector. It will be appreciated that, by employing such an integral construction of the fuel pressure regulator, the number of the connecting sections of the piping of the fuel injection system is considerably decreased as compared with conventional pipings of the fuel injection system, which decreases the number of connectors in the piping and simplifies the assembly of the fuel injection system.

Figure 3:
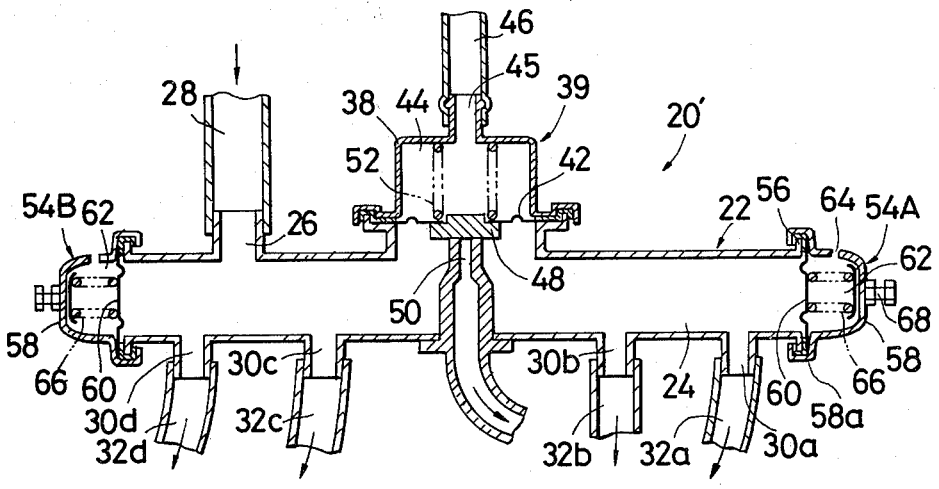
FIG. 3 is a cross-sectional view similar to FIG. 2, but showing another preferred embodiment of a fuel pressure regulator in accordance with the present invention.

FIG. 3 illustrates another preferred embodiment of the fuel pressure regulator 20', in accordance with the present invention, which is similar to the embodiment of FIG. 2 with the exception that the fuel distributor pipe 22 is provided at its both ends with two dampers 54A and 54B to soften the fuel pressure pulsation due to the intermittent opening and closing action of the valves of the fuel injectors. The two dampers 54A and 54B are the same in construction and accordingly only the damper 54A will be illustrated, assigning the same reference numerals to the same parts.

The fuel distributor pipe 22 is formed at its both ends with flange portions 56 defining openings (no numerals). As shown, the flange portion 58*a* of a diaphragm casing 58 is secured to the flange portion 56 of the distributor pipe 22, putting a diaphragm member 60 between the both flange portions 56 and 58*b*. The diaphragm casing 58 defines therein a damping chamber 62 which is communicated through an orifice 64 with the atmosphere. A spring 64 is disposed in the chamber 62 to bias the diaphragm member 60. The biasing force of the spring 66 is adjustable by a screw 68 under cooperation with a spring retainer (no numeral) for the spring 66.

Now, the fuel pressure changes due to the opening and closing actions of the fuel injectors are transmitted as fuel pressure pulsations to the fuel chamber 24 of the fuel distributor pipe 22 through the fuel supply lines 32*a* to 32*d*. Under such a condition, it is required to suppress the rapid change in fuel pressure or the fuel pressure pulsation as much as possible in order to achieve an accurate control of the fuel amount injected from the fuel injector.

In this regard, with the fuel pressure regulator 20' shown in FIG. 3, the diaphragm members 60 of the dampers 54A and 54B are moved in response to the fuel pressure pulsation applied to the fuel in the fuel chamber 24 to absorb or soften the fuel pressure pulsation. As a result, the fuel supplied through the fuel supply lines 32*a* to 32*d* cannot be affected by the fuel pressure pulsation applied to the fuel in the fuel chamber 22 of the fuel distributor pipe 22.

While the fuel discharge nozzle 50 has been shown and described to be formed as a separate member relative to the fuel distributor pipe 22, it will be appreciated that the nozzle 50 may be formed integrally with the pipe 22.

What is claimed is:

1. A fuel pressure regulator for use in a fuel injection system of a gasoline fueled internal combustion engine, said fuel pressure regulator comprising:

a fuel distributor pipe defining therein a fuel chamber, having a fuel inlet through which the fuel chamber communicates with a fuel source, and a plurality of fuel outlets equal to the number of fuel injectors, said fuel outlets communicating with the fuel chamber, and both ends of said fuel distributor pipe being open;

a plurality of fuel supply conduits, each fuel supply conduit directly connecting one of said outlets with a fuel injector;

a casing directly connected to said fuel distributor pipe to constitute an integral unit, said casing defining therein a vacuum chamber which communicates with an intake passageway of the engine;

a diaphragm member secured at a section where said distributor pipe and said casing are connected to each other, to separate said fuel chamber and said vacuum chamber, said diaphragm member being provided with a valve member;

a fuel discharge nozzle through which the fuel in said fuel chamber is dischargeable, said nozzle being disposed in said fuel chamber and closable with said valve member to prevent the fuel in said fuel chamber from being discharged out of said fuel chamber; and damper means communicating with said fuel chamber for absorbing the fuel pressure pulsation applied to the fuel in said fuel chamber of said fuel distributor pipe, said damper means including first and second dampers which are respectively provided at both open end portions of said fuel distributor pipe, each of said dampers including a diaphragm member secured to close the open end portion of said fuel distributor pipe.

2. A fuel pressure regulator as claimed in claim 1, further comprising a spring member disposed in said vacuum chamber to bias said diaphragm member so that said valve member closes said fuel discharge nozzle.

3. A fuel pressure regulator as claimed in claim 2, in which said fuel distributor pipe comprises a straight elongate pipe section including at its central portion a first flange portion defining an opening, and wherein said casing includes a second flange portion which is secured to said first flange portion, and said diaphragm member is placed between said first and second flange portions so that said diaphragm member closes the opening defined by said first flange portion.

4. A fuel pressure regulator as claimed in claim 3, in which said fuel discharge nozzle projects into said fuel chamber and is secured through the wall of said fuel distributor pipe and is located so that the tip thereof is contactable with said valve member so as to be closable.

5. A fuel pressure regulator as claimed in claim 1, in which each damper includes a casing secured to the end portion of said fuel distributor pipe to form therein a chamber defined by said diaphragm member of said damper and said casing, said casing being formed with an orifice through which said chamber communicates with the atmosphere, and a spring disposed in said chamber of said damper to bias said diaphragm member of said damper.

6. A fuel pressure regulator as claimed in claim 1, wherein said fuel distributor pipe includes at least four of said fuel outlets.

7. A fuel injection system for a gasoline fueled internal combustion engine, comprising:

a plurality of fuel injectors including one for each cylinder of the engine;

a fuel source comprising a fuel tank;

means for supplying fuel from said fuel tank to each of said fuel injectors, said fuel supply means comprising a fuel pump and a fuel pressure regulator, wherein said fuel pressure regulator comprises:

a fuel distributor pipe defining therein a fuel chamber, having a fuel inlet through which the fuel chamber communicates with a fuel source, and a plurality of fuel outlets equal to the number of fuel injectors, said fuel outlets communicating with the fuel chamber, and both ends of said fuel distributor pipe being open;

a plurality of fuel supply conduits, each fuel supply conduit directly connecting one of said outlets with a fuel injector;

a casing directly connected to said fuel distributor pipe to constitute an integral unit, said casing defining therein a vacuum chamber which communicates with an intake passageway of the engine;

a diaphragm member secured at a section where said distributor pipe and said casing are connected to each other, to separate said fuel chamber and said vacuum chamber, said diaphragm member being provided with a valve member;

a fuel discharge nozzle through which the fuel in said fuel chamber is dischargeable, said nozzle being disposed in said fuel chamber and closable with said valve member to prevent the fuel in said fuel chamber from being discharged out of said fuel chamber; and damper means communicating with said fuel chamber for absorbing the fuel pressure pulsation applied to the fuel in said fuel chamber of said fuel distributor pipe, said damper means including first and second dampers which are respectively provided at both open end portions of said fuel distributor pipe, each of said dampers including a diaphragm member secured to close the open end portion of said fuel distributor pipe.

* * * * *